US009352203B2

(12) United States Patent
Huang

(10) Patent No.: US 9,352,203 B2
(45) Date of Patent: May 31, 2016

(54) TENSILE BASKETBALL SHOOTING SKILL TRAINING DEVICE

(71) Applicant: Yingfeng Huang, Liuzhou (CN)

(72) Inventor: Yingfeng Huang, Liuzhou (CN)

( * ) Notice: Subject to any disclaimer, the term of this patent is extended or adjusted under 35 U.S.C. 154(b) by 125 days.

(21) Appl. No.: 14/370,639

(22) PCT Filed: Mar. 13, 2013

(86) PCT No.: PCT/CN2013/072556

§ 371 (c)(1),
(2) Date: Oct. 8, 2014

(87) PCT Pub. No.: WO2013/152652

PCT Pub. Date: Oct. 17, 2013

(65) Prior Publication Data

US 2015/0087448 A1 Mar. 26, 2015

(30) Foreign Application Priority Data

Apr. 8, 2012 (CN) ..... 2012 1 0099240

(51) Int. Cl.
*A63B 69/00* (2006.01)
*A63B 71/06* (2006.01)
(Continued)

(52) U.S. Cl.
CPC ..... *A63B 69/0071* (2013.01); *A63B 71/06* (2013.01); *A63B 63/00* (2013.01);
(Continued)

(58) Field of Classification Search
CPC ..... A63B 69/00
USPC ..... 473/482, 447
See application file for complete search history.

(56) References Cited

U.S. PATENT DOCUMENTS 4,623,148 A 11/1986 Juhl
4,717,149 A * 1/1988 Juhl ..... A63B 69/0071 473/429

(Continued)

FOREIGN PATENT DOCUMENTS

CN 85102082 B 10/1987
CN 2133335 Y 5/1993
CN 102000421 B 11/2011

OTHER PUBLICATIONS

International Search Report and Written Opinion for PCT/CN2013/072556, Issued on Jun. 20, 2013.

(Continued)

*Primary Examiner* — Gene Kim
*Assistant Examiner* — M Chambers
(74) *Attorney, Agent, or Firm* — Brown & Michaels, PC

(57) ABSTRACT

Disclosed is a tension basketball shooting motor skill acquisition apparatus, comprising a horizontal-shaft, a rotating-arm, a sphere and a ball-axle passing through the sphere, wherein the horizontal-shaft and the ball-axle are connected via the rotating-arm, the sphere rotates around the ball-axle, the sphere, and the ball-axle and the rotating-arm rotate around the horizontal-shaft together, there is at least one device or spring between the sphere (or a fixed part of the sphere) and the rotating-arm which limits or releases the rotation of the sphere around the ball-axle; a hinge fixed on the sphere, a fingers-plate with a laser transmitter going though it connected to the hinge, wherein the fingers-plate rotates around the hinge. By means of the fingers-plate, the hinge, the sphere and the ball-axle rotating together around the horizontal-shaft and under extreme tension and guide of laser beam, the whole process of shooting at the basket is simulated orientationally. The invention is principally used for beginners to master and bring up to standard the action of shooting at the basket, acquiring movement techniques for shooting, and it is also suitable for professional basketball players to correct and hone their movements, and to get the correct feeling prior to competitions or when resting at competition venues, increasing the hit ratio. The invention can also be used as a toy and entertainment or be fixedly installed at the sides of a basketball courts or in parks or squares for the public to do exercises with.

7 Claims, 6 Drawing Sheets

(51) Int. Cl.
*A63B 63/00* (2006.01)
*A63B 71/02* (2006.01)

(52) U.S. Cl.
CPC ..... *A63B2071/025* (2013.01); *A63B 2207/02* (2013.01); *A63B 2220/16* (2013.01); *A63B 2220/34* (2013.01); *A63B 2225/093* (2013.01)

(56) References Cited

U.S. PATENT DOCUMENTS

| | | | | |
|---|---|---|---|---|
| 5,271,617 | A | 12/1993 | Gilford | |
| 7,854,668 | B2 | 12/2010 | Shelton | |
| 8,409,036 | B1 * | 4/2013 | Khananayev ..... | A63B 69/0071 473/416 |
| 2006/0003856 | A1 * | 1/2006 | Bennett ..... | A63B 69/0071 473/447 |
| 2009/0042674 | A1 * | 2/2009 | Shelton ..... | A63B 69/0071 473/450 |
| 2010/0267496 | A1 * | 10/2010 | Johnson ..... | A63B 69/0071 473/447 |
| 2014/0171229 | A1 * | 6/2014 | Klunick ..... | A63B 69/0071 473/447 |
| 2014/0200102 | A1 * | 7/2014 | Frostino ..... | A63B 69/0071 473/447 |
| 2014/0287853 | A1 * | 9/2014 | Heiling ..... | A63B 69/0071 473/447 |
| 2015/0087448 | A1 * | 3/2015 | Huang ..... | A63B 69/0071 473/447 |

OTHER PUBLICATIONS

Huang Yingfeng "Implicit Learning and Grasping the Physical Movement Skills", Journal of Nanjing Institute of Physical Education, Feb. 2003, vol. 17, No. 1:22-28.

Huang Yingfeng and Cheng Tao "Impact of Muscle's Self-tension on Learning of Athletic Skills", Journal of Capital Institute of Physical Education, Sep. 2008, 20 vol. 5: 74-77.

* cited by examiner

TENSILE BASKETBALL SHOOTING SKILL TRAINING DEVICE

FIELD OF THE INVENTION

The present invention relates to a mechanical and optoelectronic apparatus which can accelerate the acquisition of basketball shooting motor skill.

BACKGROUND OF THE INVENTION

Basketball has a broad mass base, and is a game of wisdom, physical fitness, height, speed, flexibility and accuracy of movement, while shooting is the only way to score. Currently, basketball player shoots only depending on subjective feeling and judge; one felt it aimed, one then shot. Currently; basketball Shooting Training technology can be generally ranged over the power training, qualitative and quantitative analyses, setting and monitoring in many countries, using greater weight of a basketball than normal such as in the United States. Some prior arts in China, such as "Apparatus for training basketball-shooting quantitatively and qualitatively" (U.S. Pat. No. 85,102,082), "vibration isometric multi-angle shooting special strength training and monitoring device" (published No. 01010606936.0) etc. were not designed for motor skills acquisition, nor had they aiming system; trained by these devices, the player can not attain the ability of having orientation feeling by standing at a certain position in the field and the ability of "combining eyes and hands". The acquisition of motor skills has its law, and the traditional way to acquire motor skill is to practice thousands of times in a same movement route. After many researches, we found that the acquisition of motor skills can be accelerated by increasing the tension of integrated relevant muscles to extreme when doing practice in a fixed route. [Reference Huang Yingfeng "Implicit Learning and Grasping the Physical Movement Skills", Journal of Nanjing Institute of Physical Education, 2003.2, Volume 17, No. 1: 22-28; Huang Yingfeng and Cheng Tao "Impact of Muscle's Self-tension on Learning of Athletic Skills", Journal of Capital Institute of Physical Education, 2008.9, 20 Volume 5: 74-77.]. In the condition of keeping relative muscles selves' tension, fingers and palms as well as upper limbs moving according to a certain mechanical route mimicing shooting action, the motor skills will be easily acquired. (Such a route should be unique, and any repeat will go the same route, otherwise more irrelative motor skills or confusion will occur in the cerebellum—the store of motor skills). Due to previous aiming, the player knows that the direction is correct and his/her every effort is pointed to the basketball hoop. In actual competitions, although there will be no aiming help from this apparatus, the feelings gained from this apparatus will help him/her; this is to say that this basketball shooting training invention contains tension and sighting components, differing from any other prior art.

Of the prior arts in basketball shooting training, there is not any invention which add laser light aiming factor in practical basketball court training, while in my invention, with its accurate orienting aiming function, one can acquire shooting motor skills containing accurate visual component.

SUMMARY OF THE INVENTION

The object of the present invention is exploiting motor skills formation theory, optics, mechanical principles to provide a tension basketball shooting motor skill acquisition apparatus for basketball shooting skills training.

Firstly, I design a set of mechanical device for forearm, palm and fingers to simulate entire shooting process, wherein the forearm, palm and fingers move along with a fixed route simulating the shooting mechanical movement, while at a certain position and height in the basketball court, this route is unique; in other words, to use this set of mechanical device is to move your body repeatedly in a fixed route, so that the motor skill is easy to be acquired. Secondly, this set of mechanical device adds tension to keep forearms, palms and fingers as well as whole body moving in tension in the whole process, so that motor skills are easier to obtain. Thirdly, adding aiming system to this set of mechanical device to make sure a unique mechanical movement route couple with a shooting direction, one can acquire shooting motor skills contain accurate visual composition.

To implement these designs, the present invention uses the following technical scheme: the tension basketball shooting motor skill acquisition apparatus can choose to be mounted on unmovable surface of building or installed in movable shelve; in the choice of movable shelve, it is comprising four sub-systems: the pushing up pressing wrist and pressing fingers system, the tension generating system, the aiming system and the shelve system.

In first sub-system, the part of pushing up pressing wrist comprises a horizontal-shaft, a rotating-arm, a sphere and a ball-axle passing through the sphere, wherein the horizontal-shaft and the ball-axle are connected via the rotating-arm, the sphere rotates around the ball-axle, the sphere, and the ball-axle and the rotating-arm rotate around the horizontal-shaft together. The part of pressing fingers is comprising a hinge fixed on the sphere, a fingers-plate with a gap in itself connected to the hinge and being able to rotate around the hinge, a plate-ring, a small-bearing, a slide-bar, wherein the small bearing fixedly connects to the fingers-plate via the plate-ring, and the slide-bar fixedly connects to the rotating-arm, and the small-bearing can slide on the slide-bar; the horizontal-shaft and the ball-axle and the hinge parallel to each other and parallel to the ground level; the small-bearing, the plate-ring and the fingers-plate rotate around the hinge together, while the hinge rotates around ball-axle and the ball-axle rotates around the horizontal-shaft. There is an organ which positioning triggers the pressing wrist action, comprising an organ-hanger fixed to the ball-axle, an organ-hook with its middle part connected to the rotating-arm by a lever pin, an organ-hook return-spring with its one end fixed to the organ-hook and the other end fixed to the rotating-arm, wherein the organ-hanger and the organ-hook form a hook-up trigger which will be triggered by a trigger-rod. There is a trigger-rod with a trigger-rod sleeve at its end wrapping over the horizontal-shaft, and there is a sleeve-latch with its different latching position on the trigger-rod sleeve to modulate the height of the trigger-rod; the function of the trigger-rod is positioning the height at which the pressing wrist action starts and then pressing fingers action be incurred as a chain reaction. There is at least one fingers-blocker fixes in the fingers-plate or the surface of the sphere, functioning supporting and stabilizing fingers and palm.

The second sub-system is the tension generating system, which comprises several tension-springs as tension generator, wherein the one ends of the tension-springs connects to the organ-hanger, and the other one ends connects to the secondary-shaft; via the surfaces of fingers-plate and the sphere the tension-springs exert pressure on fingers, palms, upper limb as well as whole body in the process of exercise.

The third sub-system is aiming system: The tension basketball shooting motor skill acquisition apparatus naturally has two aiming systems to be chosen depending on the need of the player: One is the rough mechanical V-notch sight-bead aiming system; when the trigger-rod sleeve is on a certain position of the horizontal-shaft, the other end of the trigger-rod and the gap of the fingers-plate vertically project on a same point on the horizontal-shaft, and the method to determine this point is adjusting the position of the trigger-rod sleeve on the horizontal-shaft, making sure the other end of the trigger-rod close to the gap of the fingers-plate as near as possible when pushing up the sphere, and due to that the horizontal-shaft and the ball-axle and the hinge parallel to each other and parallel to the ground level, the other end of the trigger-rod and the gap of the fingers-plate will be jointly in one plane which vertical to the horizontal-shaft. When the trigger-rod and the fingers-plate are set in suitable positions, the eye sight of the player will go through the gap of the fingers-plate, and then the other end of the trigger-rod, finally the basketball hoop—at this moment a V-notch sight-bead aiming system is formed, while the gap in the fingers-plate corresponds to V-notch, and the other end of the trigger-rod corresponds to sight-bead, and the basketball hoop corresponds to the target. Another aiming system is a precise laser aiming system, which further comprises: a laser transmitter wrapped by a fingers-blocker set in the gap of the fingers-plate in the position corresponds to the middle of proximal phalanxes of the index finger and middle finger, wherein its laser light beam is perpendicular to the plane of the fingers-plate, so that the player can aim the basketball hoop on transversal orientation; a laser light diffusing device set at the target—basketball hoop; and an information receiving processing and reporting device mounted on the horizontal-shaft, which further comprises a laser light receiver, a angle and angle velocity sensor near the rotating-arm, signal cables, a single chip microcomputer SCM, a speaker, a LED display panel, a height sensor near the horizontal-shaft sleeves as well as the power supply. Aiming the basketball hoop on longitudinal orientation can be done by calculating original throwing velocity, angle, height, distance. Laser aiming system exploits the present sensing collection, laser ranging technology, SCM, LED display technology as well as speaker, collects and calculates the imagined basketball shooting height, angle as well as the distance from the hoop. In the primitive period of pushing up the sphere, the sphere simulates the actual basketball, and once pressing wrist and pressing fingers action is triggered, the imagined basketball rolls forward under the fingers-plate at the speed of the time. Setting sphere position at triggering moment as the leaving-point at which the imagined basketball leaves the player's hand, and setting this point as the origin of coordinates, Y as the ordinate and X as the abscissa, the center of the basketball hoop is in XY plane; according to parabolic motion equation:

$$X = Vt\cos\theta,\ Y = Vt\sin\theta - \frac{1}{2}gt^2,$$

in which Y is the vertical distance from the leaving-point to the basketball hoop, supposed as a, while X is the horizontal distance from the leaving-point to the basketball hoop, supposed as b, and the linear distance from the leaving-point to the basketball hoop is supposed as c which can be measured by the laser light diffusing device and laser ranging technology; so that we can design the SCM program according to the Pythagorean theorem to let X value as $b=\sqrt{c^2-a^2}$. In actual situation the basketball is smaller than the hoop, so that one can hit in when throwing a little far or a little near; thus, X can has two values $X_1$ and $X_2$ to guarantee hitting in, wherein $X_1$=b+ radius of basketball, $X_2$=b+ radius of hoop−radius of basketball; taking V as original velocity which can be calculated from angle velocity and radius of the moving circle, θ as shooting angle, t as the flying time of basketball, G as the gravitational acceleration, and according different original velocity, removing t from parabolic motion equation, we can design the program to judge whether the value of V go into the range of $V_1=X_1\times\sqrt{g/(2X_1\sin\theta\cos\theta-2Y\cos^2\theta)}$ and $V_2=X_2\times\sqrt{g/(2X_2\sin\theta\cos\theta-2Y\cos^2\theta)}$; if yes, the parabolic trajectory of imagined basketball will hit in hoop; and then the speaker will report the result. The said laser light source includes but not limits to laser, also can be visible light, infrared or other light sources.

The fourth sub-system is the shelve, which supports the apparatus and determines the position and height of shooting practice, comprising two vertical poles perpendicular to the ground level, two parallel poles parallel to the ground level, and a transversal pole with both ends fixed to one ends of a vertical pole and a parallel pole respectively, wherein vertical pole and parallel pole as well as transversal pole are perpendicular to each other; there is a pedal welded to the edges of the two parallel poles and the transversal pole, while there are four moving wheels mounted on four corners of the pedal respectively to move the whole apparatus to any wanted place in basketball court. Both sides of the horizontal-shaft fix to horizontal-shaft sleeves which covered around and being able to move along the two vertical poles; the height of the horizontal-shaft can be modulated by adjusting the horizontal-shaft sleeves lock-bolt. If the apparatus is mounted on a wall or some other places, shelve would be unnecessary.

ADVANTAGES

When the player uses the present invention, his/her fingers, palms, arms as well as whole body will be guided to simulate a complete basketball shooting action, and under the tension, his/her brain will record such a set of action, and under the help of aiming system, the player knows and feels that the direction is correct and his/her every effort is pointed to the basketball hoop.

At a certain point and height in the court, due to that the fingers-blocker fixes the position of the palm, the route of forearm is unique, and such a route is always unique no matter how many times the player repeats; in other words, doing a same action precisely according to a same route again and again will make the player gain the motor skill easily, thus it's different from other training devices; while training in other training devices, the player feels subjectively that his/her palm was put on proper position, he/she would start training, actually the tiny different put positions made his/her brain regard different routes as different motor skills formations. At present time, of all prior arts, the designed training route of forearm, palm and fingers can be many routes, and is not precisely unique.

In basketball textbooks, the shot basketball is reversely rotating in the air, but in training in the present invention, the rotation direction of the sphere is forward, seemed unreasonable; actually, the movement of the forearm, palm and fingers guided by the present invention is totally the same as described in the textbooks: in pushing up period, the sphere is simulating an actual ball, and once pressing wrist and fingers action is triggered, the sphere will no longer simulate an actual ball, but the movement of palm and fingers does—the imagined ball will keep its velocity going forward and upward, rolling reversely on the fingers-plate at the same time, so as to offer a tactile surface to the palm and fingers. In shooting exercises, the pressure of fingers exerting on the fingers-plate will point to the hoop if only the laser light beam scratches across the basketball hoop. The laser aiming system can train the player to acquire a precise feeling of when the hoop is aimed objectively, far better than before subjectively the player trained him/herself with a real ball.

DETAILED DESCRIPTION OF THE PREFERRED EMBODIMENT

According to basketball textbooks and the practices of top basketball players of the world, stationary single-handed shooting over the shoulder is the most extensively used shooting method, which is also the base of jump shooting and other kind of shootings; Such a shooting method has a high leaving-point, and is easy to combine with other technical actions, and can be played at different places and positions. Taking a right-handed shooting over the shoulder as an example, the right foot is at front and left foot a little back; both knees bend slightly, the center of gravity of the player projects between two feet; five fingers of the right hand naturally open, and let the roots and up parts of fingers contact the basketball, while empty center of palm and turn over wrist to let the palm support the back and under part of the basketball; bend the elbow and draw it a little inner forward, and let the basketball at the up and front of shoulder; the lower arm is approximately at a same level with the shoulder joint, while upper arm approximately perpendicular to the ground; left palm supports the left side of the basketball; eyes sight aims on the hoop. While shooting, feet thrust on the ground and right arm pushes up and forward, while pressing wrist and fingers, finally using fingers roll the basketball and letting it fly away from the ends of middle and index fingers; while the basketball flies away, the hand should accompany forward and the heels lift.

Figure 7:
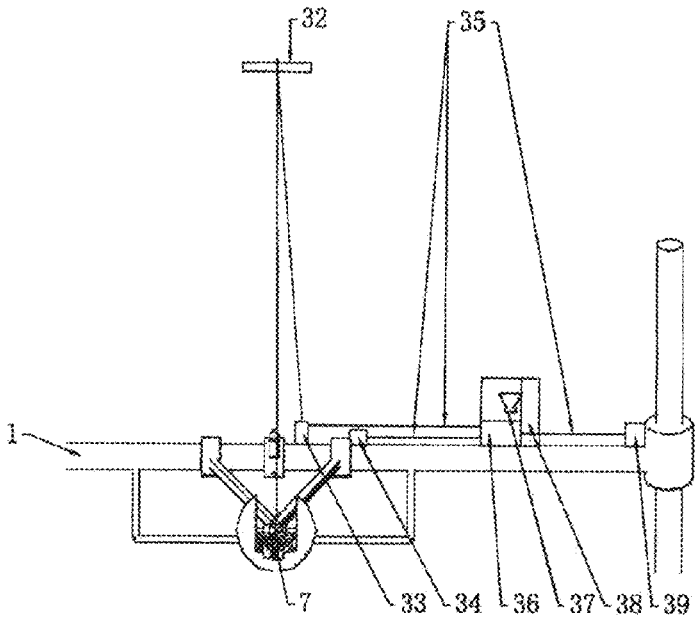
FIG. 7 is a diagram of the laser aiming system of the present invention.

Existing mechanical techniques can produce the present invention easily, and due to possible use in open court, the mechanical parts can be made of stainless steel. Laser aiming system exploits the present sensing collection, laser ranging technology, SCM, LED display technology. Referring to the drawing of FIG. 7, single laser transmitter 7 is set in the gap of the fingers-plate 6; the laser light receiver 33, the angle and angle velocity sensor 34, the signal cables 35, the single chip microcomputer SCM 36, the speaker 37, the LED display panel 38 as well as the height sensor 39 are set on the horizontal-shaft 1, composing an information receiving and processing and reporting device; the laser light diffusing device 32 can be made of a ball a little bigger than basketball hoop, wrapped by laser reflective film, being placed on the hoop.

Figure 1:
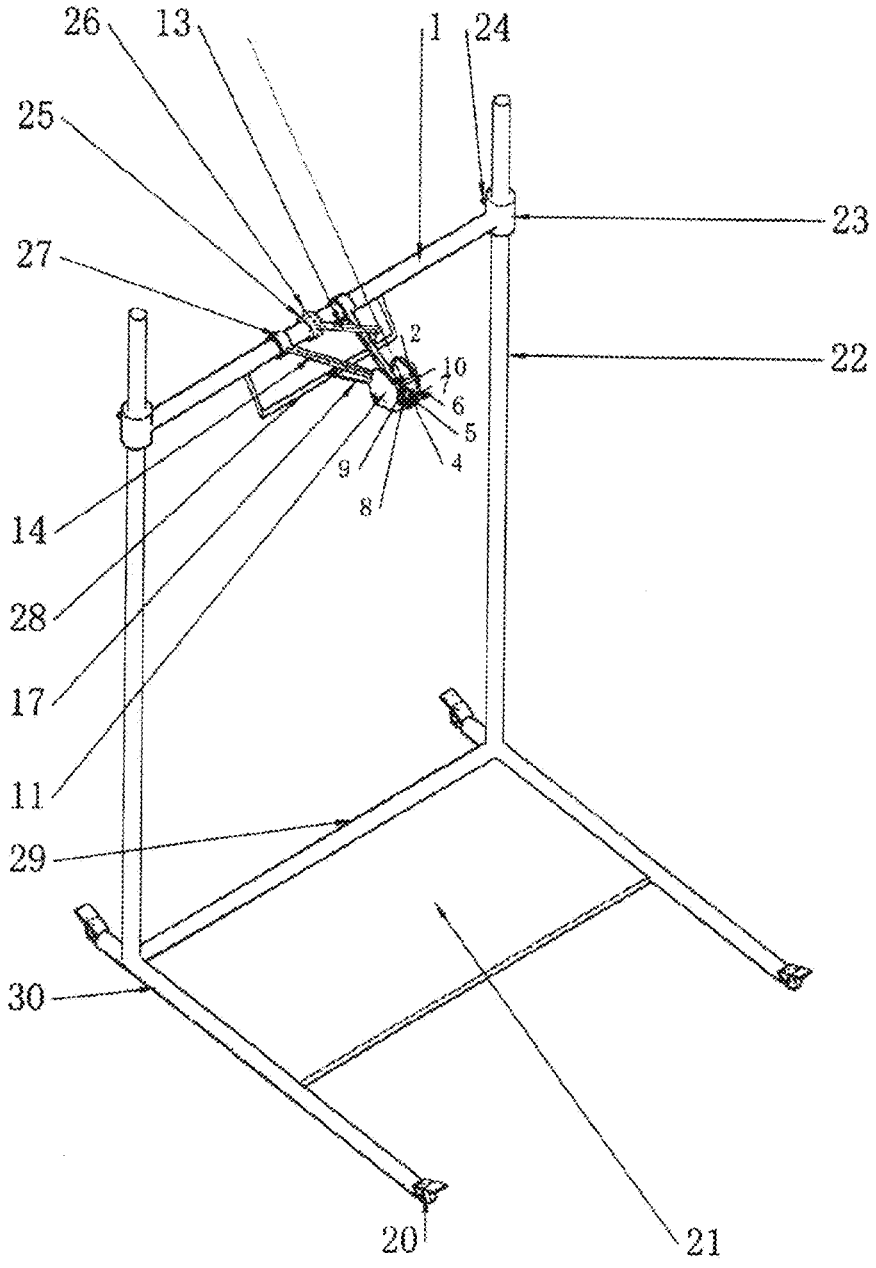
FIG. 1 is a main view of the present invention.
Figure 2:
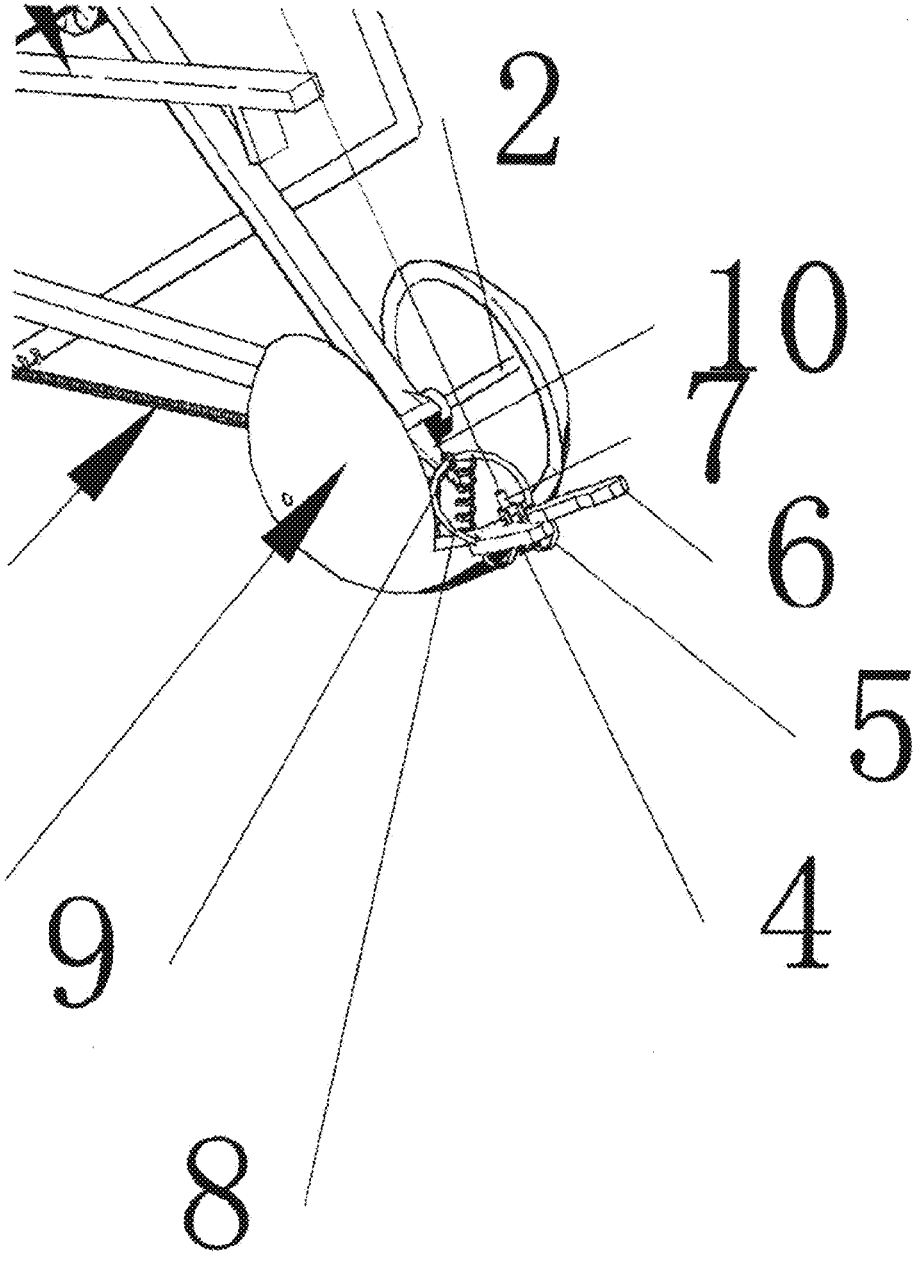
FIG. 2 is an enlarged partial structure view of the present invention.
Figure 3:
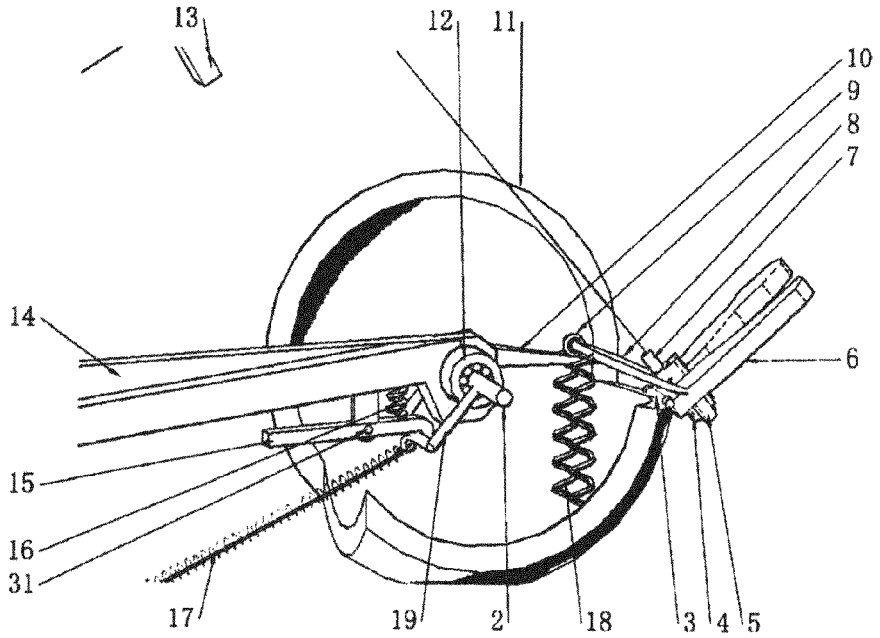
FIG. 3 is a sectional view of the sphere of the present invention.
Figure 4:
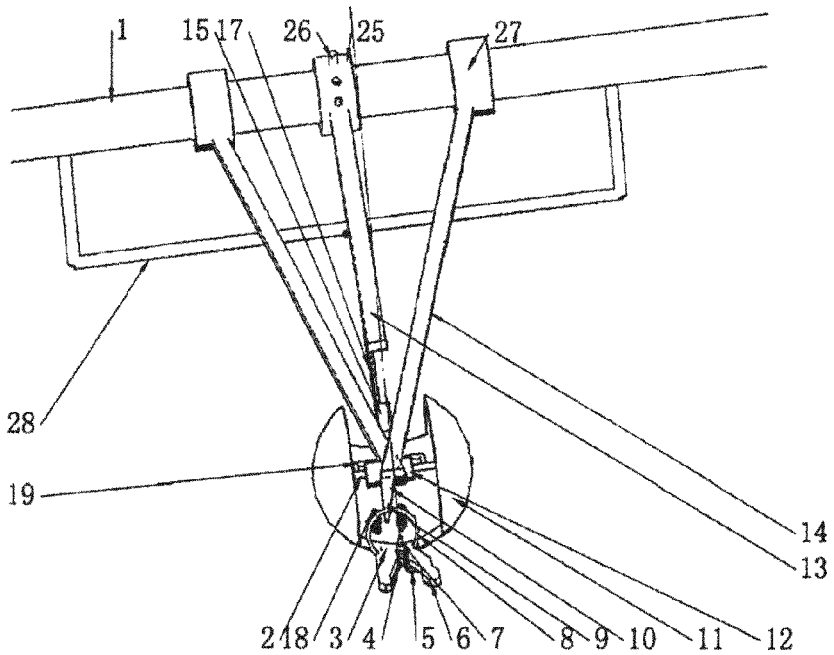
FIG. 4 is a partial structure view of the present invention.
Figure 5:
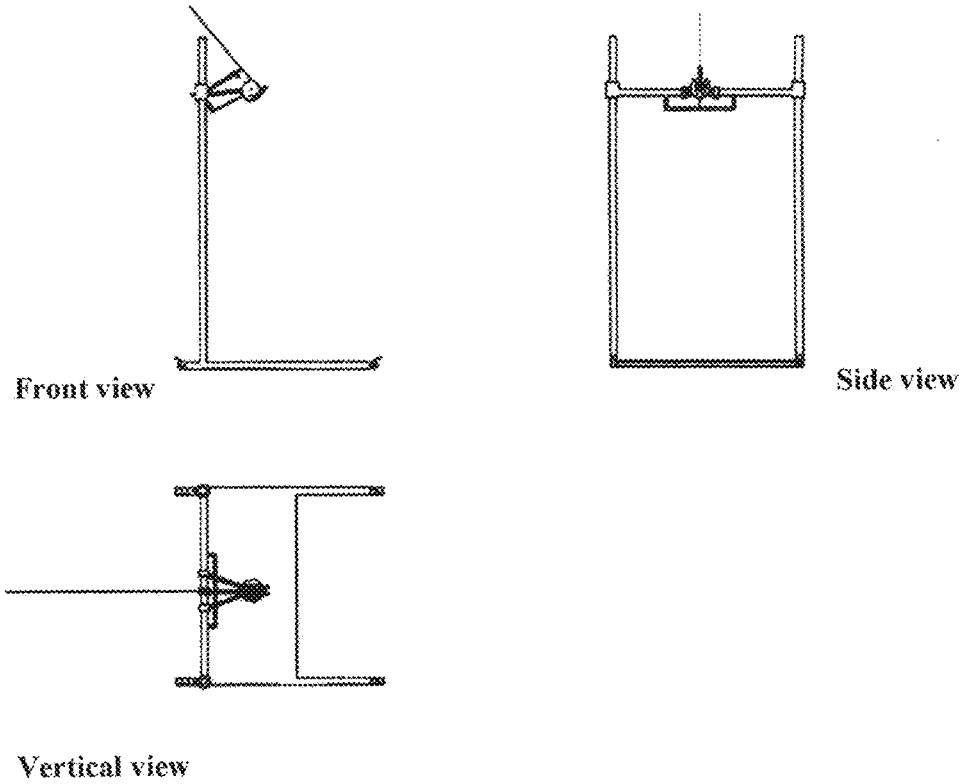
FIG. 5 is a three-view of the present invention.
Figure 6:
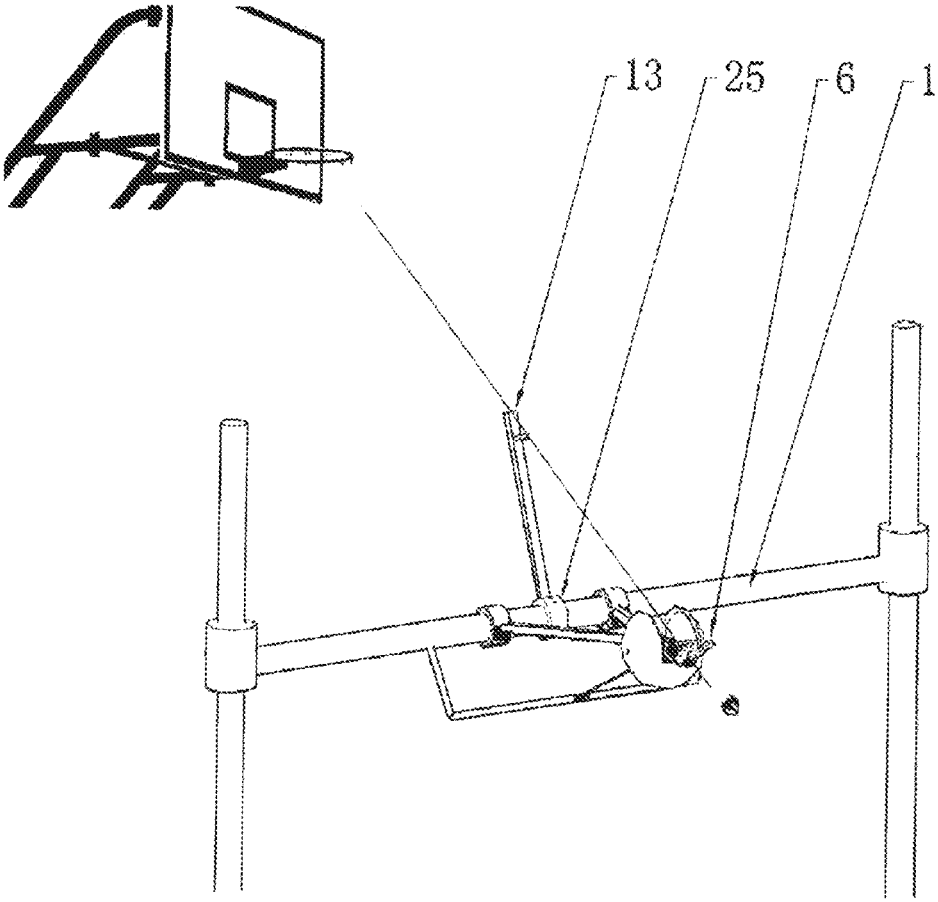
FIG. 6 is a diagram of the V-notch sight-bead aiming system of the present invention.

Referring to the drawing of FIGS. 1-5, one end of the rotating-arm 14 connects to the horizontal-shaft 1 via two rotating-arm bearings 27, the other end fixes on the outer ring of the ball-axle bearing 12, while the inner ring of the ball-axle bearing 12 fixedly covers the ball-axle 2. When practicing, firstly player moves the apparatus on the moving wheels 20 to a certain place in basketball court, then steps on the pedal 21 surrounded by two parallel poles 30 and the transversal pole 29, switches on the power of the laser transmitter 7, moves the shelve and pushes up the sphere 11 to let the laser beam aim on the basketball hoop—in an alternate embodiment, if one wants to do a rough aiming, referring to the drawing of FIG. 6, uses the mechanical V-notch sight-bead aiming system; then, according to the height of the player and the shooting height the player want to play, adjusts the lock-bolt 24 to modulate the height of the horizontal-shaft sleeves 23 on the vertical poles 22, so as to modulate the height of the horizontal-shaft; then turns the trigger-rod sleeve 25 and latches it with the sleeve-latch 26, so as to modulate the height of trigger-rod 13. Referring to the drawings of FIG. 2-4, let the right hand fingers naturally open, and let middle finger and index finger go through the finger-sheathes 5 and be held by fingers-blocker 4, with the inner side of fingers contacting the surface of the sphere 11 and the fingers-plate 6, and with the palm empty. Puts the right palm under the sphere 11, bends the elbow of the right arm moves the elbow a little inner-forward, and puts the left palm on the left side of the sphere 11. Pushes the sphere 11 up according to shooting action, and the sphere 11 follows the rotation of the rotating-arm 14 going up, consequently the tension-springs 17 with one ends at secondary-shaft 28 will be pulled, the force of the tension-springs 17 will be exerted on the fingers, the palm and the arm as well as the whole body of the player via the sphere 11, making the player's body in tension; keeps pushing up the sphere 11 until the organ-hook 15 touches the trigger-rod 13, successively, due to leverage function, the organ-hook 15 turns around the lever pin 31 and presses the organ-hook return-spring 16, and the organ-hanger 19 will unhooked from the organ-hook 15, finally pressing wrist and pressing fingers action will be triggered; at this moment, the rotating-arm 14 won't go up any more, but the continuous pushing of palm pushes the sphere 11 rotating around the ball-axle 2, while the rotation of the sphere 11 brings the fingers-plate 6 and the plate-ring 8 to turn forward and upward, consecutively makes the small-bearing 9 on the slide-bar 10 tends to leave the slide-bar 10, and the fingers-plate 6 gains a space to press forward, and under the press of the middle finger and index finger the fingers-plate 6 turns around the hinge 3. Actually the small-bearing 9 does not leave the slide-bar 10, but slides on the slide-bar 10. Such a movement keeps going until the palm and the forearm form an angle of approximate 90 degree, while pressing fingers-spring 18 be pressed to its extreme, simulation of throwing out the ball is finished. The function of the fingers-spring 18 is firstly exerting counter-force to middle finger and index finger via the fingers-plate 6, secondly is cushioning, and thirdly is offering rebounding force when the palm going back. After the palm and fingers go to the limited position, due to the rebounding force of the tension-springs 17 and pressing fingers-spring 18, the sphere 11 will rotate in an opposite direction, and the palms and forearms also go down accompanying the sphere 11; in the same time the organ-hanger 19 also rotates reversely back to touch the organ-hook 15, pressing the organ-hook return-spring 16, and be hooked up again. The whole action is to be completed continuously, just as an actual shooting in one throw, and repeats above action again and again, the player will gain the shooting motor skill. In the process of shooting exercise above, the laser aiming system works simultaneously; when the organ-hook 15 touches the trigger-rod 13, take the velocity of the sphere as the original velocity of imagined basketball, the angle between the moving direction of the sphere 11 and the ground level as shooting angle θ, the height and the original velocity of the imagined basketball can be make out from the angle and angle velocity sensor 34 sensing the angle and angle velocity of the rotating-arm 14, the height of the horizontal-shaft 1, and the actual radius of the rotating-arm 14 rotating around the horizontal-shaft 1: the height of the imagined basketball=the height of the horizontal-shaft 1+the actual radius of the rotating-arm 14 rotating around the horizontal-shaft 1*con θ, and the original velocity of the imagined basketball=angle velocity*the actual radius of the rotating-arm 14 rotating around the horizontal-shaft 1; Due to the need of pressing wrist forward, there is a bias angle β in the shooting angle θ, β approximately equal to the angle of fingers-plate 6 has turned when the hinge 3 turns around the ball-axle 2 for a radian approximately equal to the length of the index finger of the player; As for a finished tension basketball shooting motor skill acquisition apparatus product and a player with certain length of the index finger, β is a fixed value; thus, the shooting angle is θ, β when calculating the parabolic motion of imagined basketball; The information is conveyed by signal cables 35 to the single chip microcomputer SCM 36 which has already been programmed in advance, and the shooting height, original velocity, shooting angle as well as the distance to the hoop of imagined basketball are calculated out; and taking vertical orientation as ordinate and level orientation as abscissa, the imagined basketball goes a parabolic trajectory; when the shooting position and angle are fixed, only a certain range of original velocity will let the parabolic trajectory go through the coordinates of basketball hoop, and the program will process and report the result via LED panel and speaker. If the precision demand is not high, the V-notch sight-bead aiming system can be the alternative, referring to FIG. 5.

Figure 8:
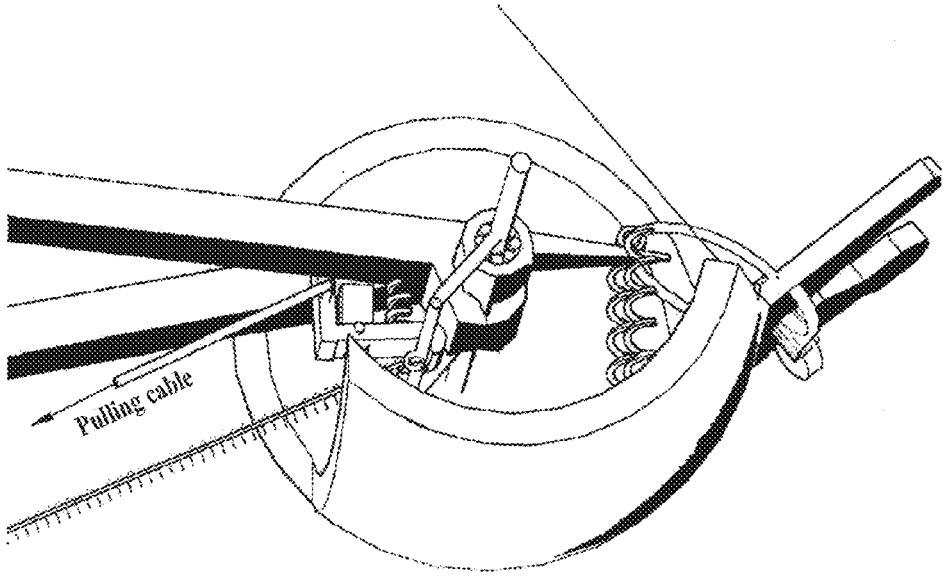
FIG. 8 is a diagram of pulling trigger style in another embodiment of the present invention.

In other embodiment, the method to trigger pressing wrist and fingers action can be pulling style or other styles, referring to FIG. 8; the merit of pulling style is avoiding blocking eye sight of players by trigger-rod The invention is principally used for beginners to master and bring up to standard the action of shooting at the basket, acquiring movement techniques for shooting, and it is also suitable for professional basketball players to correct and hone their movements, and to get the correct feeling prior to competitions or when resting at competition venues, increasing the hit ratio. The invention can also be used as a toy and entertainment or be fixedly installed at the sides of a basketball courts or in parks or squares for the public to do exercises with.

What is claimed is:

1. A basketball training apparatus, comprising a horizontal-shaft (1), a rotating-arm (14), a sphere (11) and a ball-axle (2) passing through the sphere (11), wherein the horizontal-shaft (1) and the ball-axle (2) are connected via the rotating-arm (14), the sphere (11) rotates around the ball-axle (2), the sphere (11), and the ball-axle (2) and the rotating-arm (14) rotate around the horizontal-shaft (1) together and wherein said apparatus further comprising an organ which positioning triggers the pressing wrist action, the organ further comprises an organ-hanger (19) fixed to the ball-axle (2), an organ-hook (15) with its middle part connected to the rotating-arm (14) by a lever pin (31), an organ-hook return-spring (16) with its one end fixed to the organ-hook (15) and the other end fixed to the rotating-arm (14).

2. The apparatus of claim 1, further comprising a hinge (3) fixed on the sphere (11), a fingers-plate (6) with a gap in itself connected to the hinge (3), wherein the fingers-plate (6) rotates around the hinge (3).

3. The apparatus of claim 1, further comprising several tension-springs (17) or pendants as tension generator, wherein the one ends of the tension-springs (17) connects to the organ-hanger (19), and the other one ends connects to the secondary-shaft (28).

4. The apparatus of claim 2, further comprising a plate-ring (8), a small-bearing (9), a slide-bar (10), wherein the small bearing (9) fixedly connects to the fingers-plate (6) via the plate-ring (8), and the slide-bar (10) fixedly connects to the rotating-arm (14), and the small-bearing (9) can slide on the slide-bar (10), and the horizontal-shaft (1) and the ball-axle (2) and the hinge (3) parallel to each other and parallel to the ground level.

5. The apparatus of claim 4, characterized in that there is a mechanical aiming system which further comprises a trigger-rod (13), a trigger-rod sleeve (25), wherein one end of the trigger-rod (13) is connected to the trigger-rod sleeve (25) mounted on the horizontal-shaft (1); wherein when the other end of the trigger-rod (13) and the gap of the fingers-plate (6) vertically project on a same position on the horizontal-shaft (1), and the trigger-rod (13) and the fingers-plate (6) are set in suitable heights respectively, a V-notch sight-bead aiming system is formed, aiming the basketball hoop, while the gap in the fingers-plate (6) corresponds to V-notch, and the other end of the trigger-rod (13) corresponds to sight-bead.

6. The apparatus of claim 4, characterized in that there is laser aiming system which further comprises:

a laser transmitter (7) wrapped by a fingers-blocker (4) set in the gap of the fingers-plate (6) in the position corresponds to the middle of proximal phalanxes of the index finger and middle finger, wherein the laser light beam of said laser transmitter (7) is perpendicular to the plane of the fingers-plate (6);

a laser light diffusing device (32) set at the target—basketball hoop; and an information receiving processing and reporting device mounted on the horizontal-shaft (1), which further comprises a laser light receiver (33), a angle and angle velocity sensor (34) near the rotating-arm (14), signal cables (35), a single chip microcomputer SCM (36), a speaker (37), a LED display panel (38), a height sensor (39) near the horizontal-shaft sleeves (23) as well as the power supply.

7. The apparatus of claim 6, wherein the said laser light source includes but not limits to laser, also can be visible light, infrared or other light sources.

* * * * *